United States Patent [19]
Sato
[11] 4,192,333
[45] Mar. 11, 1980

[54] TENT

[75] Inventor: Tomoyoshi Sato, Tokyo, Japan
[73] Assignee: Nihon-Yohin Co., Ltd., Tokyo, Japan

[21] Appl. No.: 955,794
[22] Filed: Oct. 30, 1978
[51] Int. Cl.² ..... A45F 1/12
[52] U.S. Cl. ..... 135/3 E; 135/15 CF
[58] Field of Search ..... 135/15 CF, 3 E, 1 R, 135/3 R, 15 R, 5 R; 52/57, 63; 182/139

[56] References Cited

U.S. PATENT DOCUMENTS

| | | | |
|---|---|---|---|
| 1,843,312 | 2/1932 | Ames | 135/3 E |
| 2,123,268 | 7/1938 | Young | 182/139 |
| 2,363,916 | 11/1944 | Waterman | 135/1 R |
| 3,004,623 | 10/1961 | Nissen | 182/139 |
| 3,058,480 | 10/1962 | Blanchard | 135/3 E |
| 3,965,625 | 6/1976 | White | 135/15 CF |
| 3,973,364 | 8/1976 | Seaman | 135/1 R |

*Primary Examiner*—Reinaldo P. Machado
*Attorney, Agent, or Firm*—Armstrong, Nikaido, Marmelstein & Kubovcik

[57] ABSTRACT

In a tent of the type wherein a tent body or proper is suspended from tent poles to pitch the tent; a structure wherein a cord, tape or the like is placed along a ridgeline formed on the upper surface of the tent proper, or the like, wherein portions for mounting the cord, tape or the like and the tent proper are disposed at intervals, thereby to form loops, and wherein engaging portions such as hooks are formed on the tent proper between the adjacent mounting portions. Further, in a tent of the type wherein a tent proper is suspended from tent poles to pitch the tent; a structure wherein mounting portions and engaging portions are alternately formed on ridgelines on the upper surface of the tent proper, wherein a cord is inserted through the mounting portions lying on the identical ridgeline, wherein loops formed of the cord between the adjacent mounting portions are caused to stride a tent pole, and wherein the loops are engaged with the engaging portions.

8 Claims, 13 Drawing Figures

TENT

BACKGROUND OF THE INVENTION

This invention relates to improvements in a tent of the type in which a tent body or proper is set up to tent poles in a suspended state.

Heretofore, in the tent of the type in which it is pitched with a tent proper suspended from tent poles, the tent poles have been inserted through mounting portions disposed on the surface of the tent proper, or hooks installed on the tent proper have been directly engaged with the tent poles. With the former expedient, the labor of inserting the tent poles through the mounting portions is complicated. In this respect, if the number of nipples for insertion is decreased, the ridgeline of the tent is not extended along the tent pole, so that the habitability of the tent is sharply spoilt and that the pitching of the tent becomes weak. With the latter expedient, in case of putting the hooks on the tent pole which is flexed into the form of a semicircle, the hooks are prone to slide, and it is difficult to safely bring them into engagement at desired positions. Besides, the function of adding to the toughness of the tent pole cannot be attained. Further, the job of engaging the individual hooks with the tent pole is complicated. With the tent having been already known, in case where the distance between the tent pole and the ridgeline of the tent needs to be locally different depending on the configuration of the ground for pitching the tent, the adjustment of the distance is impossible. Since the hooks installed on the tent proper are directly engaged with the tent pole, the mounting operation is comparatively simple. However, when the number of the hooks is decreased, the ridgeline of the tent is not extended along the tent pole. When the number of the hooks is increased, the simplicity of the mounting operation is spoilt. Inevitably, the operation of setting up the tent and the tent pole in conformity with the configuration of the ground becomes impossible. In addition, loads are concentrated on the hook parts of the tent proper, so that the tent proper is prone to damage.

SUMMARY OF THE INVENTION

This invention has for its object to provide a tent which is free from the disadvantages of the prior arts as described above.

More specifically, according to this invention, a loop formed of a chord or tape is engaged with an engaging member astride a tent pole. Owing to the frictional resistance between the tape and the tent pole and the relation between the loop and the engaging member, the engagement with the tent pole is stabilized, and loads on the tent pole are made uniform. Moreover, the angagement is done under the state under which the ridgeline of the tent proper is flexed along the tent pole. Therefore, the habitability is excellent. Also the pitching operation is very prompt and easy because the operation of engaging the tent proper with the tent pole can be executed by a labor of only about a half of that in the prior-art system in which the hooks are directly engaged with the tent pole. The operation of setting up the tent proper to the tent pole in a suspended state is conspicuously simple. The ridgeline of the tent is flexed along the flexure of the tent pole, and the pitching strength of the tent proper as well as the fixing strength of the tent pole is remarkably enhanced. By regulating the degree of tension of the tent, the resistance against wind and rain is adjusted. By locally loosening or tightening the tent proper in conformity with the configuration of the ground for pitching the tent, the tent is put into a flat form conforming with the configuration of the ground, a stout tent pitching is permitted in any configuration of ground.

BRIEF DESCRIPTION OF THE DRAWING

The accompanying drawing illustrates embodiments of this invention, wherein.

DETAILED DESCRIPTION OF THE INVENTION

Figure 1:
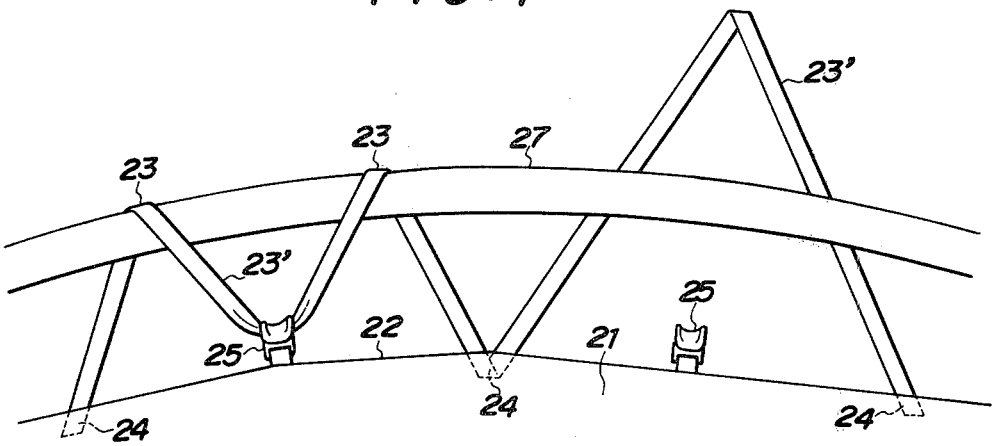
FIG. 1 is a side view of a part of a tent showing a first embodiment of this invention.

This invention will now be described in detail in connection with embodiments illustrated in the drawing.

FIG. 1 shows an embodiment of this invention. A single cord or tape 23 is stretched along the ridgeline 22 or the like of a tent body or proper 21, and several places thereof are fixed to the tent proper 21 at intervals so as to form mounting portions 24. Hooks 25 are disposed on, or in the vicinity of, the ridgeline 22 between the adjacent mounting portions 24. Loops 23' are formed of the cord or tape 23 between the adjacent mounting portions 24.

Figure 2:
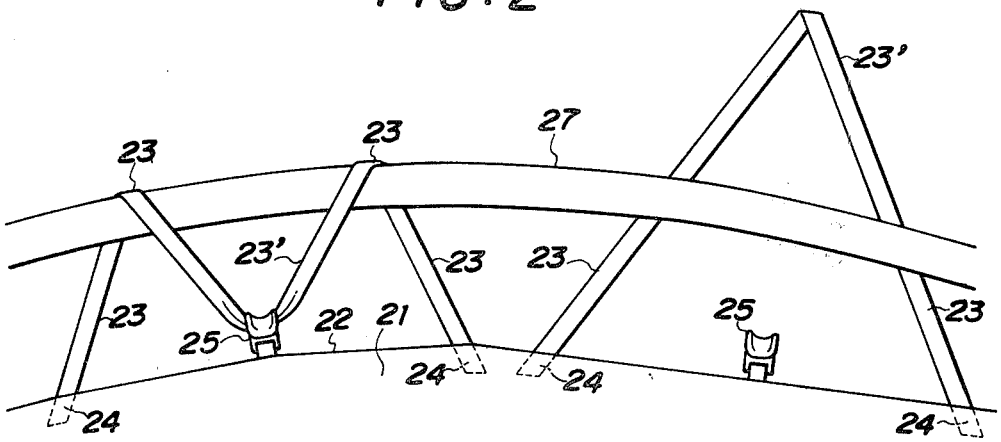
FIG. 2 is a side view of a part of a tent showing a second embodiment of this invention.

FIG. 2 shows another embodiment. Both ends of each of a plurality of short cords or tapes 23 are fixed at intervals along the ridgeline 22 or the like of a tent proper 21, thereby to form several loops 23'. Hooks 25 are formed on, or in the vicinity of, the ridgeline between the adjacent loops.

Figure 3:
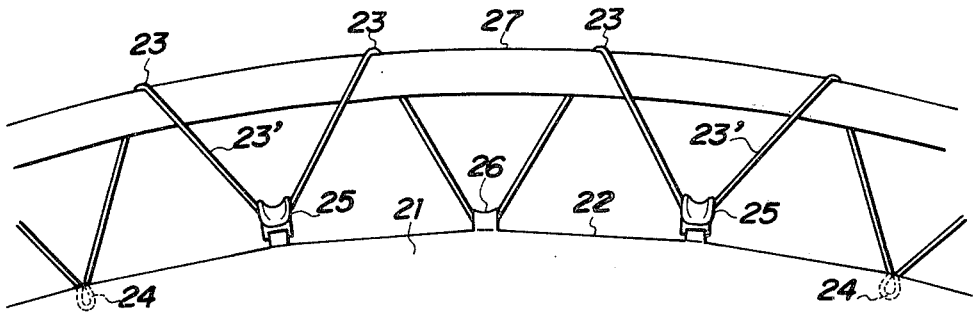
FIG. 3 is a side view of a part of a tent showing a third embodiment of this invention.
Figure 4:
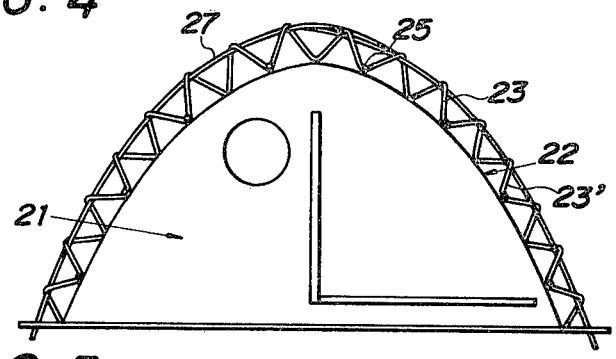
FIG. 4 is a front view of the tent according to this invention.
Figure 5:
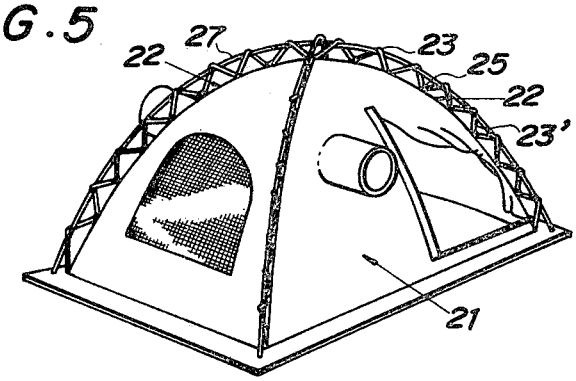
FIG. 5 is a perspective view of the tent according to this invention.
Figure 6:
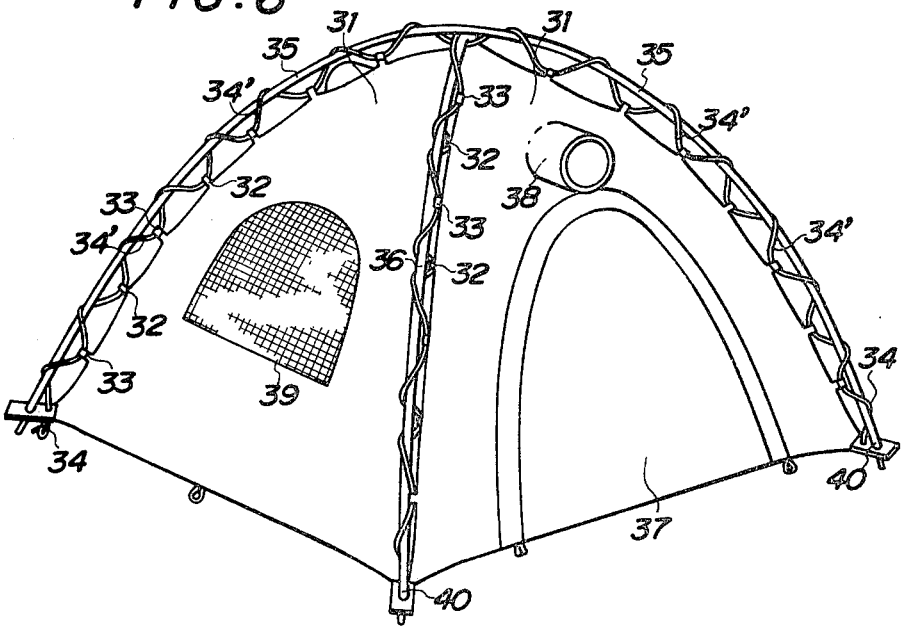
FIG. 6 is a perspective view showing the pitched state of a tent according to this invention.
Figure 7:
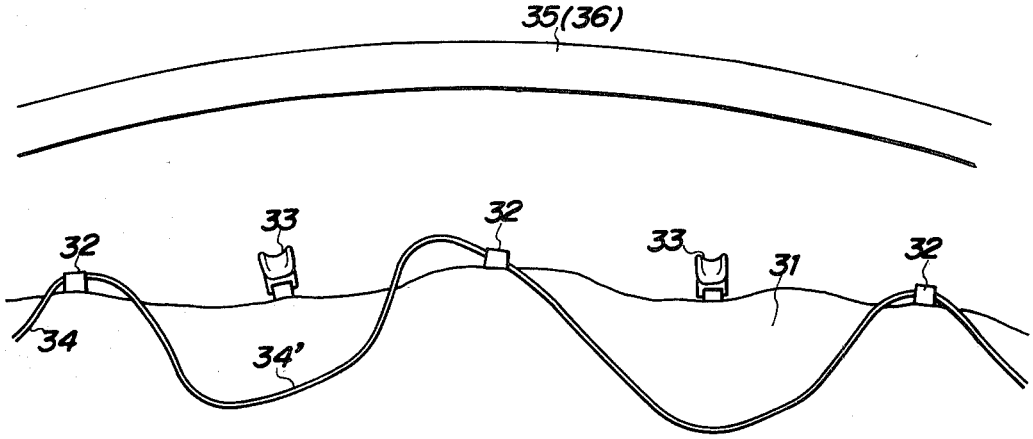
FIG. 7 is a perspective view showing the relation according to this invention between a tent pole and a loop lying between mounting portions, the relation being in an un-pitched state.
Figure 8:
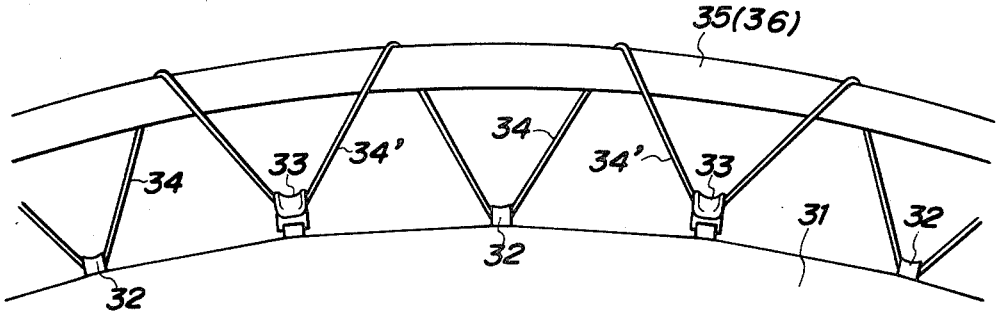
FIG. 8 is a perspective view showing a state according to this invention in which a loop between mounting portions is caused to stride a tent pole and engaged with an engaging portion.
Figure 9:
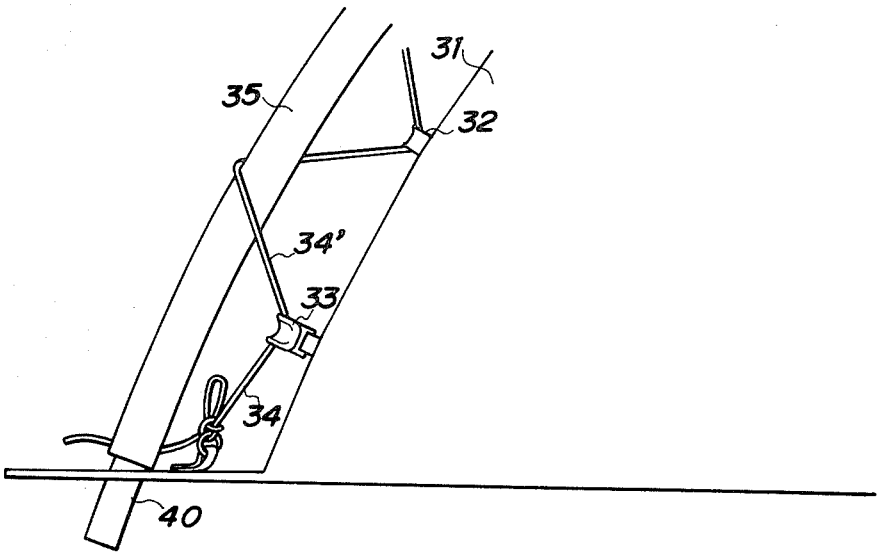
FIG. 9 is a perspective view of a lower part of a tent according to this invention in a state in which a tent proper is attached to a tent pole.
Figure 10:
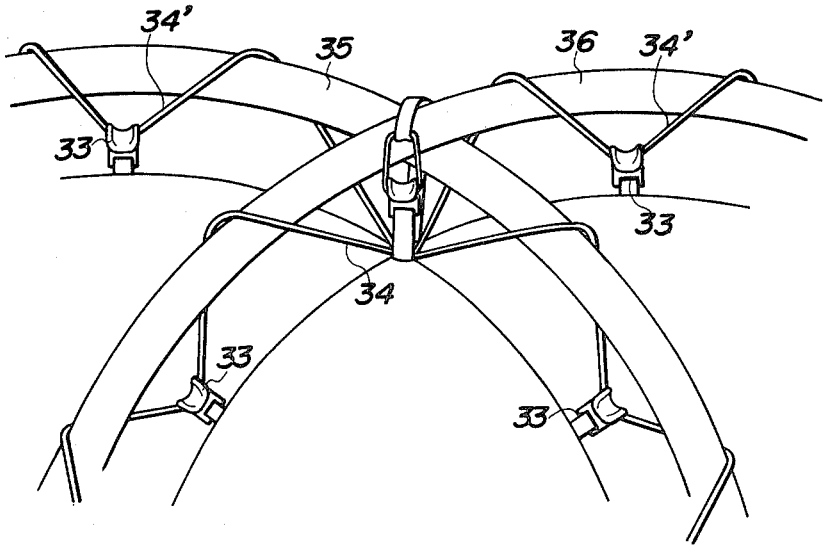
FIG. 10 is a perspective view of a top part of a tent according to this invention in the state in which the tent proper is attached to the tent pole.
Figure 11:
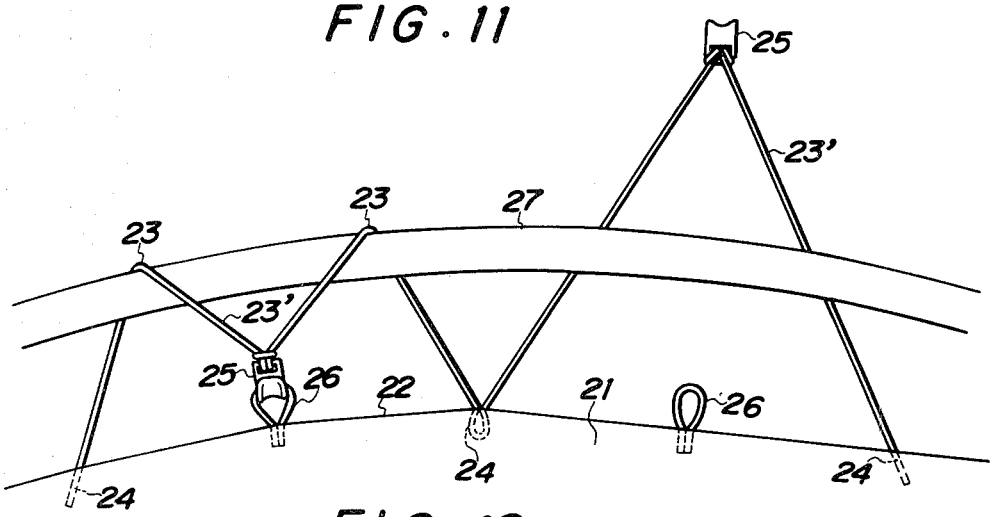
FIG. 11 is a side view of a part of a tent showing an aspect of application of the first embodiment according to this invention (refer to FIG. 1)
Figure 12:
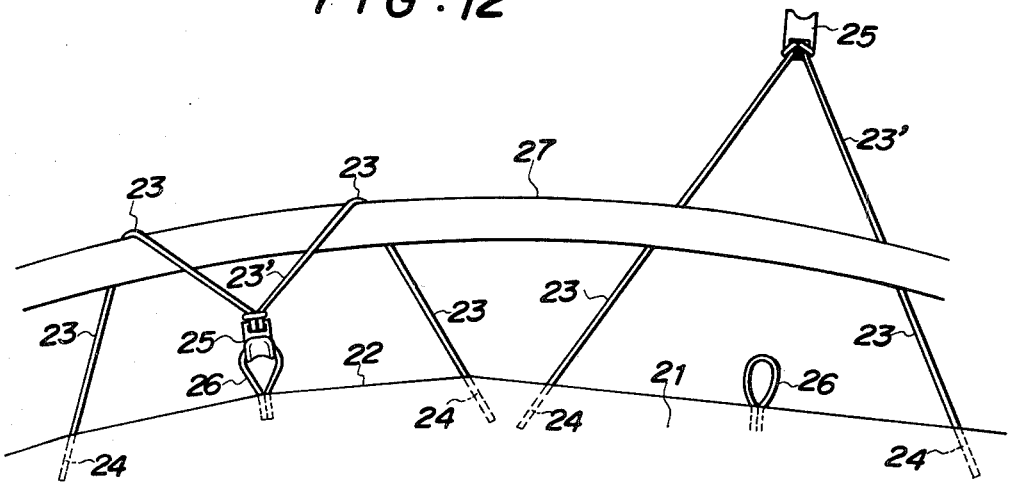
FIG. 12 is a side view of a part of a tent showing an aspect of application of the second embodiment according to this invention (refer to FIG. 2)
Figure 13:
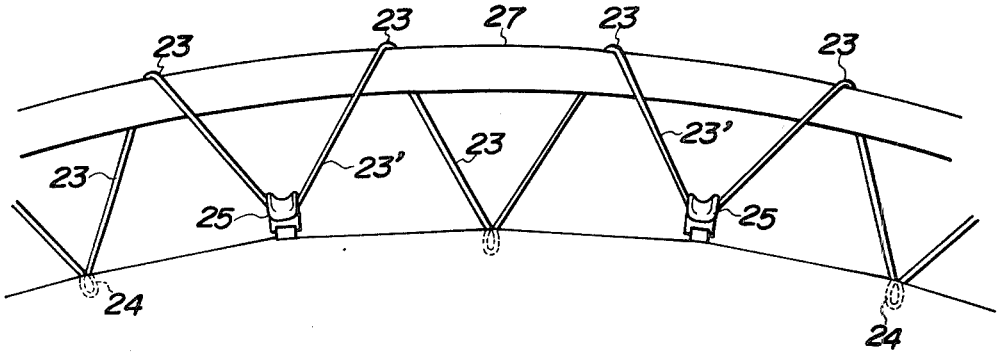
FIG. 13 is a side view of a part of a tent showing an aspect of application of the third embodiment according to this invention (refer to FIG. 3).

FIG. 3 shows still another embodiment. A single cord or tape 23 is stretched along the ridgeline 22 of a tent proper 21 or in proximity thereto, and several places of the cord or tape 23 are fixed to the tent proper 21 at intervals so as to form mounting portions 24. Hooks 25 and a nipple or ring 26 through which the cord or tape 23 is inserted are disposed between the adjacent mounting portions 24. A loop 23' is formed between the mounting portion 24 and the nipple or ring 26.

This invention consists in that the loop 23' strides a tent pole 27 and engages the hook 25 being an engaging member, thereby to firmly fix the tent proper 21 to the tent pole 27. Since the loop 23' formed of the cord or tape 23 is engaged with the engaging member 25 astride the tent pole 27, the frictional resistance between the cord or tape 23 and the tent pole 27 becomes great. Conjointly with the fact that the hook 25 and the mounting portion 24 are respectively fixed to the tent proper 21, the great resistance eliminates the fear of the occurrence of a shift or slide in the engaged part and ensures a stable engagement. Simultaneously, loads on the tent pole 27 are averaged, whereby the strength of the tent pole 27 can be made still higher. Besides, since the loop is held in engagement under the state under which the ridgeline 22 of the tent proper 21 or the vicinity thereof is flexed along the flexure of the tent pole 27, the habitability is excellent. Furthermore, the labor of the engagement is very simple, and the tent can be promptly pitched.

Now, an embodiment shown in FIGS. 6 to 10 will be described.

On diagonal lines of a tent body or proper 31, suspending and fastening lines in which mounting portions 32 and engaging portions 33 are alternately provided are disposed in a manner to intersect with each other. By passing a cord 34 through the mounting portions on the identical diagonal line, loops 34' are formed between the adjacent mounting portions 32. Two flexible tent poles 35 and 36 (extension tent poles, or non-flexible tent poles may well be used) are curved and caused to intersect. Ends of the tent poles are inserted through pole inserting holes 40 of the tent proper 31, and are buried in the ground. The parts of the loops 34' formed of the cord 34 lying between the mounting portions 32 of the tent proper 31 are engaged with the engaging portions 33 astride the tent pole 35 or 36. Subsequently, one end of the cord 34 is fixed to the tent or the tent pole or to the ground. Thereafter, the other end is pulled to set up the tent in a tightened state, and it is fixed to the tent or the tent pole or to the ground. Of course, both the ends or one end of the cord 34 may be fixed to the tent proper 31 in advance. In the drawing, numeral 37 designates an entrance of the tent, numeral 38 a hood, and numeral 39 a window.

This invention is as stated above. The portions of the loops 34' formed of the cords 34 between the adjacent mounting portions 32 are engaged with the hook portions 33 in a manner to stride over the tent poles 35 and 36, and one end of each cord 34 is pulled, whereby the tent is pitched in the tightened state, so that the pitching operation of the tent can be executed very simply. By regulating the degree of tension of the tent against the tent poles, the resistance of the tent against a strong wind can be adjusted. By locally loosening or tightening the loops 34', the tent is put into a flat form conforming with the configuration of the ground for pitching it, so that a tent set-up rich in durability against wind and rain can be executed irrespective of the configuration of the ground. With the tent according to this invention, the operation of engagement to the tent poles can be reduced by half as compared with that in the prior-art method in which the hooks are directly engaged with the tent poles. Neverthless, an equal or greater effect of engagement is attained. Since the ridgeline of the tent is formed along the flexure of the pole, the habitability is excellent, and the strength of the tent is high. In some cases, special fittings for suspending the top of the tent are unnecessary.

I claim:

1. A structure of an outer type tent wherein a cord, tape or the like is mounted at intervals along a ridgeline of an outer pole type tent proper, or the like, loops are formed of the cord lying between the mounting portions, engaging portions such as hooks are disposed between said mounting portions, and said loops are engaged with said engaging portions astride the tent pole.

2. A structure of a tent as defined in claim 1, characterized in that a single cord or tape is located along a ridgeline of a tent proper, or the like, that several places of the cord or tape are fixed to said tent proper at intervals, to form mounting portions, that hooks are disposed on, or in the vicinity of, the ridgeline between the adjacent mounting portions, and that loops are formed of the cord or tape between the adjacent mounting portions.

3. A structure of a tent as defined in claim 1, characterized in that both ends of each of a plurality of short cords or tapes along a ridgeline of a tent proper, or the like, are fixed at intervals, thereby to form a pulurality of loops, and that hooks are formed on, or in the vicinity of, the ridgeline between the loops.

4. A structure of a tent as defined in claim 1, characterized in that a single cord or tape is located along a ridgeline of a tent proper or along the vicinity thereof, that several places of the cord or tape are fixed to the tent proper at intervals, to form mounting portions, that hooks and nipples, rings or the like for inserting the cord or tape are disposed between the adjacent mounting portions, and that loops are formed between the mounting portions and the nipples, rings or the like.

5. A structure of a tent as defined in claim 1, wherein engaging members such as hooks are mounted on loops formed of a cord or tape disposed along a ridgeline of a tent proper, or the like, and said engaging members are engaged with engaging portions mounted on said tent proper astride a tent pole.

6. A structure of a tent as defined in claim 1, wherein mounting portions and engaging portions such as nipples and rings are alternately formed along a ridgeline of an upper surface of a tent proper, or the like, a cord is inserted through the mounting portions lying on the identical line, loops formed of the cord situated between the adjacent mounting portions are caused to stride a tent pole, and said loops are engaged with said engaging portions.

7. A structure of a tent as defined in claim 1, characterized in that suspending and fastening lines in which mounting portions and engaging portions such as nipples and rings are alternately formed are disposed on diagonal lines of a tent proper in a manner to intersect each other, that a cord is inserted through the mounting portions on the identical diagonal line, thereby to form loops between the adjacent mounting portions, that two flexible tent poles or extension tent poles or non-flexible tent poles are flexed and caused to intersect each other, that ends of both the tent poles are inserted through pole inserting holes of said tent proper and buried in a ground, that the loop portions formed of the cord lying between the adjacent mounting portions of said tent proper are engaged with said engaging portions astride said tent pole, that one end of said cord is fixed to said tent proper, said tent pole or the ground, and that the other end of said cord is pulled to set up the tent in a tightened state and then fixed to said tent proper, said tent pole or the ground.

8. A method of fabricating an outer pole type tent, comprising mounting a cord, tape or the like along a ridgeline of an outer pole type tent proper, or the like, at intervals, forming loops of the cord situated between the mounting portions, and disposing engaging portions such as hooks between said mounting portions.

* * * * *